US006023232A

United States Patent [19]

Eitzenberger

[11] Patent Number: 6,023,232

[45] Date of Patent: Feb. 8, 2000

[54] VEHICLE COMMUNICATIONS SYSTEM AND METHOD

[75] Inventor: Klaus Eitzenberger, Wernau, Germany

[73] Assignee: DaimlerChrysler AG, Stuttgart, Germany

[21] Appl. No.: 08/881,166

[22] Filed: Jun. 23, 1997

[30] Foreign Application Priority Data

Jun. 22, 1996 [DE] Germany ..... 196 25 002

[51] Int. Cl.[7] ..... G08G 1/123

[52] U.S. Cl. ..... 340/988; 340/426; 340/955

[58] Field of Search ..... 340/988, 990, 340/991, 994, 995, 425.5, 426, 825.31, 825.34

[56] References Cited

U.S. PATENT DOCUMENTS

| | | | |
|---|---|---|---|
| 5,055,660 | 10/1991 | Bertagna et al. | 340/825.31 |
| 5,142,396 | 8/1992 | Divjak et al. | 340/825.72 |
| 5,504,482 | 4/1996 | Schreder | 340/995 |
| 5,546,311 | 8/1996 | Sekine | 340/995 |
| 5,629,868 | 5/1997 | Tessier et al. | 348/164 |
| 5,648,768 | 7/1997 | Bouve | 340/988 |
| 5,682,133 | 10/1997 | Johnson et al. | 340/426 |
| 5,736,941 | 4/1998 | Schutle et al. | 340/995 |

FOREIGN PATENT DOCUMENTS

| | | | |
|---|---|---|---|
| 41 10 372 C2 | 10/1991 | Germany | 340/988 |
| 42 18 804 A1 | 12/1993 | Germany | 340/988 |
| 44 03 712 A1 | 11/1995 | Germany | 340/988 |
| 95/13577 | 5/1995 | WIPO . | |

OTHER PUBLICATIONS

"ATIS—A Modular Approach", IEEE Plans '92 Position Location and Navigation Symposium, Jan. 1, 1992, pp. 528–533, XP000344347.

*Primary Examiner*—Jeffery A. Hofsass
*Assistant Examiner*—Van T. Trieu
*Attorney, Agent, or Firm*—Evenson McKeown Edwards & Lenahan, PLLC

[57] ABSTRACT

A vehicle communications system and method includes a central computer for performing data networking applications, individual devices for transmitting, receiving, recording, and/or processing data associated with the data networking applications, and one or more data transmission channels with associated interfaces through which the individual devices can be connected with a central vehicle computer. According to the invention, the individual devices are flexibly associated in a controllable fashion with the various data networking applications, with an adaptive application control being provided that selects the individual devices on the basis of their functions that are required for performing a given application, and controls the necessary data transmission processes.

11 Claims, 5 Drawing Sheets

VEHICLE COMMUNICATIONS SYSTEM AND METHOD

BACKGROUND AND SUMMARY OF THE INVENTION

This application claims the priority of German Patent Application No. 196 25 002.1 filed in Germany on Jun. 22, 1996, the disclosure of which is expressly incorporated by reference herein.

The invention relates to a vehicle communications system and method with a central computer for performing data networking applications, with individual devices for transmission, reception, recording and/or processing of data associated with these applications and with one or more data transmission channels with corresponding interfaces by which the individual devices can be connected with a central computer.

The use of data networking systems, in other words electronic data transmission systems that use telecommunications services, are becoming increasingly important, including in the area of vehicle technology. Thus for example telecommunications services are already employed in vehicles that have permitted new functions in the areas of traffic control, safety, dynamic navigation aids, and the "mobile office."

Conventional data networking systems of this kind consist of an independent computer with interfaces to a special radio device, for example a GSM or Modacom device, and/or to a positioning receiver such as a GPS receiver. The telecommunications devices currently available on the market basically differ in terms of interface protocol. Although efforts have been made at standardization, interface protocols differ from one another depending on the manufacturer of the device, the version, the model, and the technology, so that thus far there have been only individual solutions with precisely defined components and interfaces. Integration of several data networking functions into a vehicle has therefore until now taken the form of isolated solutions separate from one another since the associated radio devices and peripherals have no network interfaces that would allow them to be used in a multifunctional fashion for several different applications. Such an architecture of a vehicle communications system requires constant maintenance of the system for making changes. The associated organizational and logistic expense results in a very limited ability of such vehicle communications systems to react to data networking functions and components as they are introduced to the market.

A vehicle communications system of the type generally described above is disclosed for example in German Patent Document DE 44 03 712 A1 in the form of an on-board computer that can be removed from the vehicle, said computer including control functions for vehicle navigation, traffic radio, and a telephone system.

German patent DE 41 10 372 C2 describes a multiplex transmission system for a vehicle that incorporates two networks and a gateway network node through which data can be transmitted between the networks.

A basic problem with conventional vehicle communications systems of the type generally described above results from the fact that the driver units for the individual devices and the interfaces, in other words the device and interface gateways, form inseparable units with the respective interfaces that are provided for connecting the individual devices in question. The individual devices are addressed by the required application by means of the computer through the unalterably set architecture of the respective interfaces and device gateways and associated interfaces. A flexible control of the individual devices through another interface or replacement of one individual device by a unit with the same function but of a different type is not possible without considerable adaptation expense since for this purpose, not only must the affected interfaces and device gateways be adapted, in other words replaced by different versions, but because of this measure, changes are also required in the computer itself and/or the application for adaptation to altered data formats, etc. A conventional system of this kind is described in general terms in the article by A. Kirson, ATIS—A Modular Approach, IEEE Plans '92 Position Location and Navigation Symposium, Jan. 1, 1992, page 528, wherein route planning, route guidance, access to databases, and user interface functions are mentioned as applications. German Patent Document DE 42 18 804 A1 shows a system that has a certain amount of flexibility as far as display of vehicle information is concerned, for which purpose an information management system is provided by which information is displayed in a motor vehicle, flexibly and adapted to individual requirements, prepared, and stored, with the system having to be designed so that it is open to future requirements and is therefore easily expanded.

A goal of the present invention is to provide a vehicle communications system which offers increased flexibility in implementing data networking applications at relatively low expense.

This and other goals have been achieved according to the present invention by providing a vehicle communications system, comprising: a central computer which performs data networking applications; a plurality of individual devices for transmitting, receiving, recording, and/or processing data associated with the data networking applications; at least one data transmission channel with associated interfaces by which the individual devices can be connected with the central vehicle computer; and an adaptive application control separate from the data networking applications which communicates with the data networking applications through a uniform data format that is independent of the interfaces and the individual devices, the application control selecting flexibly and on the basis of function, the individual devices and the interfaces required for the individual data networking applications, the application control controlling the necessary data transmission processes, for which purpose the application control includes device gateways and interface gateways separate from the device gateways, which gateways the application control selects independently of one another, flexibly and on the basis of function, in order to control the respective individual devices through the respective interfaces.

This and other goals have also been achieved according to the present invention by providing a method of controlling a vehicle communications system having a central computer which performs data networking applications; a plurality of individual devices for transmitting, receiving, recording, and/or processing data associated with the data networking applications; at least one data transmission channel with associated interfaces by which the individual devices can be connected with the central vehicle computer; and an adaptive application control separate from the data networking applications, the application control including device gateways and interface gateways separate from the device gateways, said method comprising: communicating with the data networking applications via said adaptive application control through a uniform data format that is independent of the interfaces and the individual devices; selecting flexibly and on the basis of function the individual devices and the interfaces required for the individual data networking applications via said adaptive application control; and independently selecting said gateways flexibly and on the basis of function via said application control, in order to control the respective individual devices through the respective interfaces.

According to the present invention, the individual devices for transmitting, receiving, recording, and/or processing the data associated with the data networking applications are not permanently associated with an individual data networking application as an isolated solution, but this arrangement is designed to be flexible. An adaptive application control that can be integrated into the central computer or located externally with respect to the central computer selects the necessary individual devices on the basis of their function for performing an individual application and controls the required data transmission processes. This permits a modular system design in which individual devices from different manufacturers can be connected to one or more suitable interfaces of the central computer.

Each individual device can be addressed on the basis of its function, in other words for fulfilling a specific function associated with it, such as position determination for example. When necessary, the individual device can fulfill this function not only for a specific data networking application but for every such application for whose performance this function is required. Redundancy to perform a specific function for several data networking applications can therefore be avoided when necessary. Conversely, a function such as vehicle position determination for example can be designed with redundancy if required, with the corresponding information being made available at different quality levels from several position determination channels independently of one another.

In addition, the vehicle communications system can be easily expanded with new individual devices and/or data networking applications without the already existing system design having to be changed. With device and interface gateways provided for the purpose, in other words in software- or hardware-based driver units for the interfaces and the individual devices connected to them, the adaptive application control is able to transform incoming data into the particular type of data format required at the output so that the individual devices required for an individual application can be controlled flexibly through the corresponding interfaces. The application control is then able to select the required suitable device and interface gateways flexibly and on the basis of function, from all of the gateways.

According to certain preferred embodiments, at least one of a CAN, a RS232, a PCMCIA, a D2B, and an IR interface is provided for connecting the individual devices to the central computer.

According to certain preferred embodiments, the individual devices comprise at least one of a GPS receiver, a PDA unit, a GSM unit, a CD-ROM unit, and an RDS-TMC unit.

According to certain preferred embodiments, the data networking applications comprise at least one of a fleet management application, a route planning application, a remote diagnosis application, an antitheft protection application, and an electronic data communications application.

Other objects, advantages and novel features of the present invention will become apparent from the following detailed description of the invention when considered in conjunction with the accompanying drawings.

DETAILED DESCRIPTION OF THE DRAWINGS

Figure 1:
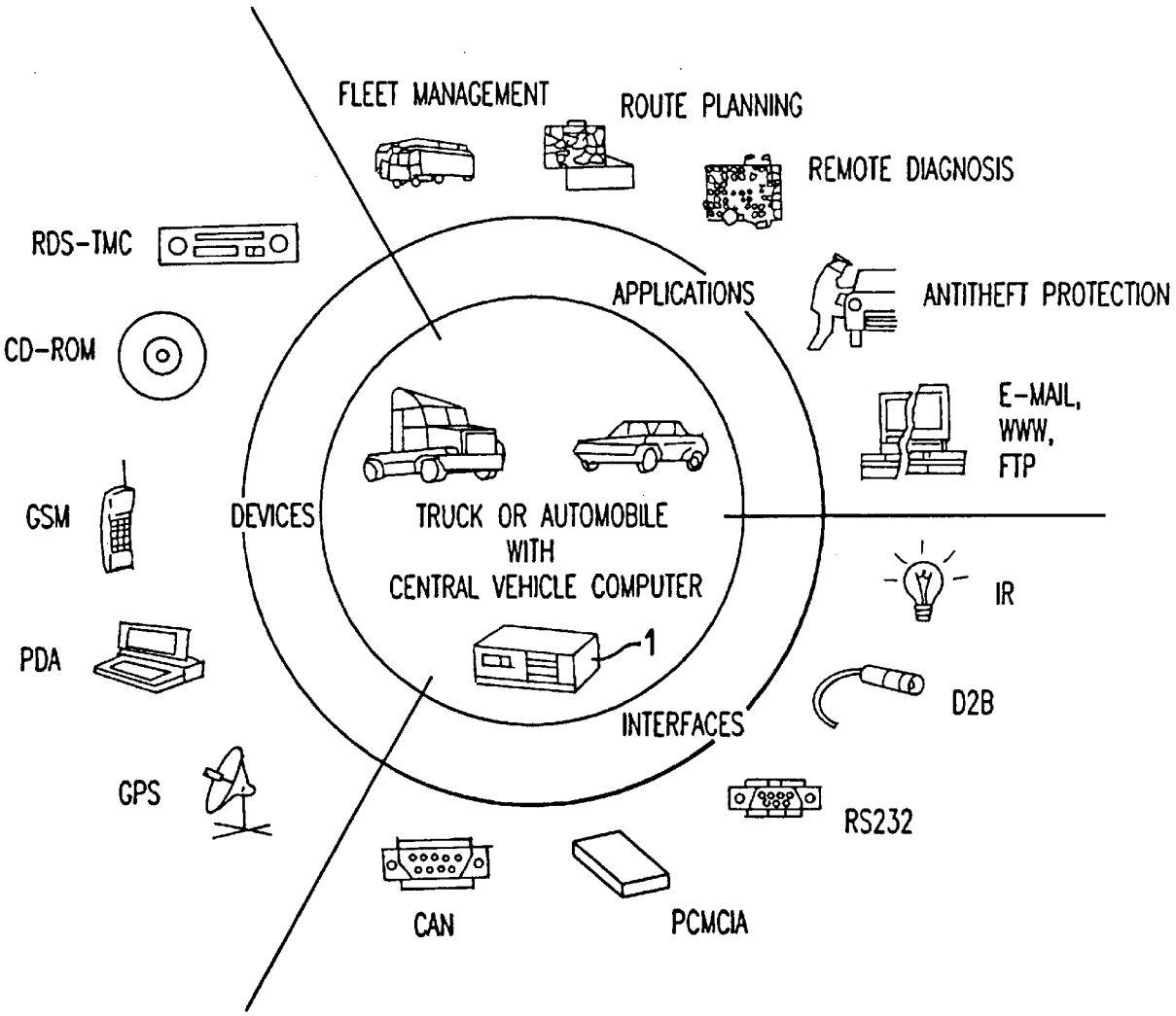
FIG. 1 is a schematic overview of the essential components of a vehicle communications system according to a preferred embodiment of the present invention.

FIG. 1 shows the essential elements of the vehicle communications system. The heart of the system is a central computer (1) installed for example in an automobile or truck, with which computer a plurality of data networking applications can be performed, namely the applications of fleet management, route planning, remote diagnosis, antitheft protection, and data communications such as the sending of electronic mail and access to databases. The data networking applications can be integrated into central computer (1) as hardware or software packages, or can be in the form of an independent control device or a software package on an external mobile computer.

A plurality of individual devices can be connected with central computer (1), in this example in particular a GPS (Global Position System) receiver, a mobile computer in the form of a PDA (personal digital assistant), a cellular telephone (GSM-Global System for Mobile), a CD-ROM (Compact Disc—Read Only Memory) unit, and an RDS-TMC (Radio Data Service—Traffic Message Channel) device. Various interfaces are used to connect these devices to central computer (1), such as a CAN (Controller Area Network), a PCMCIA, (Personal Computer Memory Card International Association) an RS232, an IR, and/or a D2B interface. The initials IR stand for an infrared interface and D2B (digital domestic bus) stands for an interface of an optical data bus network that is used in vehicles manufactured by Mercedes-Benz AG. The other terms are standard expressions. Of course, depending on the application, the system can comprise more or fewer applications, devices, and/or interfaces.

Data communications between the devices and central computer (1) takes place over the data transmission channels associated with the interfaces. The devices, unlike in conventional systems, are not each associated with a specific application, but are called upon flexibly to fulfill their inherent functions by an adaptive application control that in this example is integrated into central computer (1), a situation that could apply to several different data networking applications.

The adaptive application control is designed so that the application does not control a specific device but reports to the control, an outgoing or incoming desire to communicate. The control then selects the most suitable device and the corresponding communications channel for the purpose. In this manner, applications can address devices from different manufacturers and do not require any information about which network the desired device must be addressed on. Instead, the adaptive application control takes over the guidance of the data transmission and converts the data package in accordance with the required network protocol through special gateways. Several applications can use the same device for communication, with the adaptive application control deciding which connection requirements take precedence, while connecting the corresponding communications channel to the device. As a result, the provision of redundant equipment on the vehicle, with identical devices for different data networking applications, can be avoided. Conversely, when necessary, certain functions can be performed in a redundant fashion over different information channels; for example, determination of the current vehicle position can be performed optionally by GPS, cellular phone, and/or a beacon system.

Figure 2:
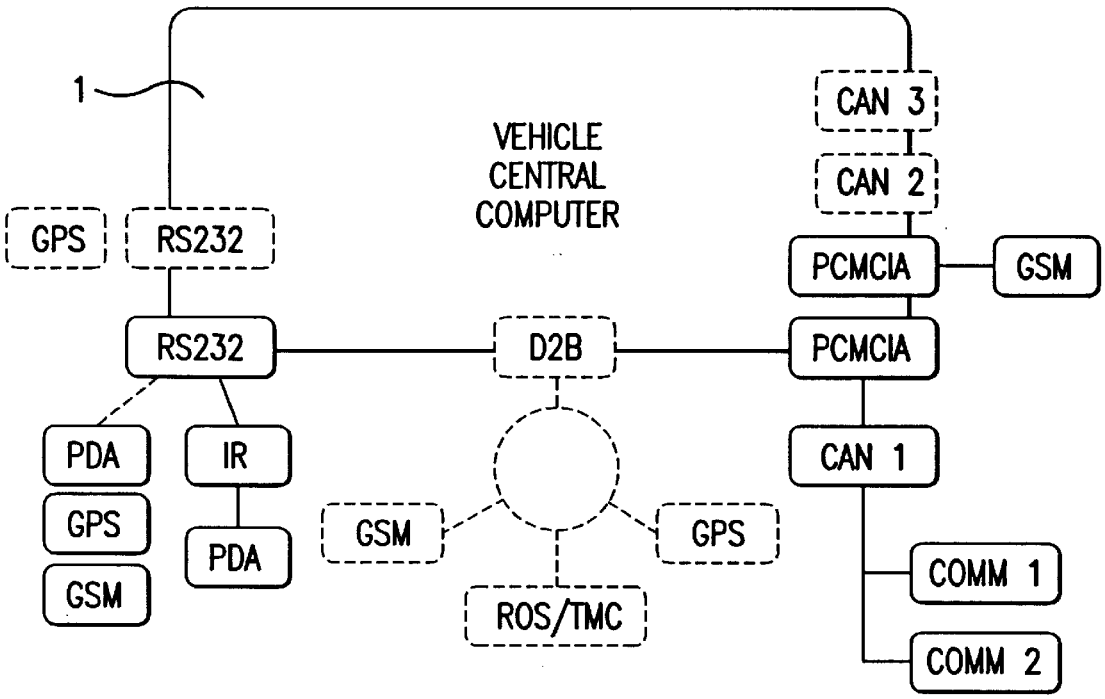
FIG. 2 is a schematic block diagram of the central computer used for the vehicle communications system in FIG. 1 with associated interfaces and individual devices connectable thereto.

FIG. 2 shows the interfaces provided for example on central computer (1) as well as the individual devices that can be connected to them, with the components surrounded by frames composed of dashed lines being considered as optional expansions. Central computer (1) has a serial RS232 interface, to which an infrared transceiver (IR) with an RS232 interface is connected for an optical link to a PDA unit. Optionally, the PDA unit can also be connected directly to this RS232 interface to which a GPS receiver or a data-capable cellular phone (GSM) can also be connected instead. Moreover, central computer (1) has a PCMCIA interface to which a GSM unit is connected. The GPS receiver can be connected optionally with central computer (1) through another RS232 interface. A CAN data bus (CAN1) with communications devices connected downstream (COM1, COM2) is connected through a second PCMCIA interface to central computer (1). These two communications units for example can each be a control device for a hardware implementation of the applications of remote diagnosis and antitheft protection. The GPS receiver (GSM unit and/or RDS-TMC unit) can be connected to central computer (1) through an optical data bus ring if this data transmission channel is provided in the vehicle. Central computer (1) is advantageously equipped with a real-time-capable multitasking operating system and can serve as a point of connection in a heterogeneous network environment.

The adaptive application control offers safe data transport for those data networking applications whose communications relationship with the individual devices involved is firmly established, for example by identifiers that have been entered, whereupon a check is performed to determine whether the required device is occupied at the moment and to which data network it is currently connected. Such applications include for example remote vehicle diagnosis implemented on a control device or transmission of electronic mail using a PDA. In addition, the system contains so-called integrated data networking applications that are designed specifically for use in connection with the adaptive application control, such as the fleet management application. In addition, basic services are implemented in the system that offer functionalities that other basic services and the integrated applications can access explicitly, once again making it possible to avoid redundant design of such functionalities.

These basic services can be divided into functions for determining data to be provided to the outside, such as position determination, time determination, etc. as well as so-called gateways that transform an incoming data stream on the basis of information from an integrated application or a basic service making a request. As far as gateways are concerned, a distinction must be made between interface gateways, device gateways, and format gateways. The interface gateways transform incoming data into the interface or data bus format of the associated interface and vice versa, while the device gateways transform incoming data into a data format suitable for the corresponding device and conversely transform data coming from the device into the appropriate output data format. The format gateways convert the data obtained by a basic service into another (standard) format, for example the position data of the vehicle. In addition to the basic services, added-value services can also be provided that differ from the basic services in that they in turn call up the latter. An example of this is the added value service known as RDS-TMC that receives currently relevant traffic information and weighs it in terms of the current vehicle position, which is a basic service.

Figure 3:
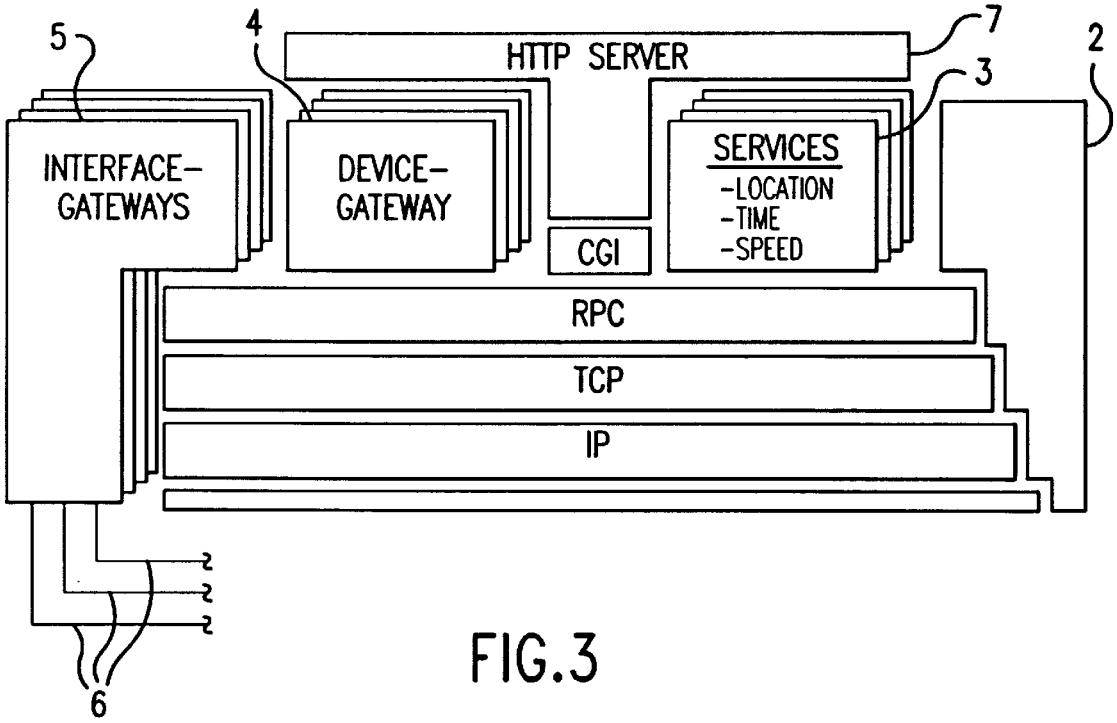
FIG. 3 is a schematic block diagram of a design of an adaptive application control integrated into the central computer in FIG. 2.

FIG. 3 is a schematic diagram showing a design of the adaptive application control that is suitable for performing the above functions. The adaptive application control in this system design includes a control unit (2) that handles adaptive information management. In addition, a number of basic and added value services (3) are illustrated, used for example for determining vehicle position, time, and vehicle speed. The control also contains a number of device gateways (4) associated with the corresponding device units. In addition, it contains the required interface gateways (5) whose output leads (6) run to the corresponding interfaces. Control unit (2) has the primary functions of preparing the basic services for integrated applications, updating the database, and controlling the topology and resources of the system, the currently occupied components, and the available and/or active client/server relationships. Another goal is monitoring access and security. In the sense of a master/slave concept, control unit (2) is itself a part of the server network, and acts as the master for the other servers.

For communication within the environment of the adaptive application control, a suitable communications architecture is provided that uses the so-called ISO/OSI reference model as the basic structure. The interprocess communication is designed so that the applications are completely independent of the underlying communications structures. Communication between two processes takes place via so-called communications endpoints, and one of the communicating processes can be located outside the vehicle. To implement client-server structures, mechanisms are provided for transparent callup of server functions and correct, transparent data preparation. The required interprocess communication is provided by a top RPC (remote procedure call) communications layer. In this way, the locations of the applications communicating with one another is completely transparent on the central computer itself, or remotely from the latter. There is also a possibility of processing service requirements of one or more service providers, so that the inclusion of potentially conflicting applications with possibly different quality of service can take place via the communications platform itself. This redundancy then leads to a higher availability of an application since when one provider fails, a provider with a similar function can intervene at the communications platform itself. An example of this is the vehicle position determination optionally by GPS, GSM, or coupled navigation.

The communications architecture also includes a data transport layer, here in the form of a TCP layer for example.

Another communications layer in the form of a network layer, an IP layer for example, handles the addressing of the computer on which the communications partner is located, for example by using address conversion. Below the IP layer, display takes place on the physically present transmission media, with a security layer taking care that transmission errors in the medium between neighboring nodes is detected and corrected if required. An HTTP server unit (7) permits communication with external databases, through an Internet connection for example. With this design, the adaptive application control firstly performs network management that includes management tasks at all levels of the communications architecture, and secondly an applications management that covers all of the tasks of a dynamic adaptive client/server environment.

According to the client/server concept, an application can act as a client or a server. Whether communication with the outside world is required and what individual devices are used for the purpose on a given occasion is not relevant for the application. An individual device is connected by an interface with central computer (1) and represents either a communications endpoint or an access point to another communications channel, especially for communication with partner devices external to the vehicle. As a result of this device transparency, it is readily possible to replace one device by another, for example one from another manufacturer, in which another data format may be used. When several different devices are available for performing a given function, the adaptive application control makes the decision as to which device is the most suitable at the moment. The respective application itself remains unaffected.

Figure 4:
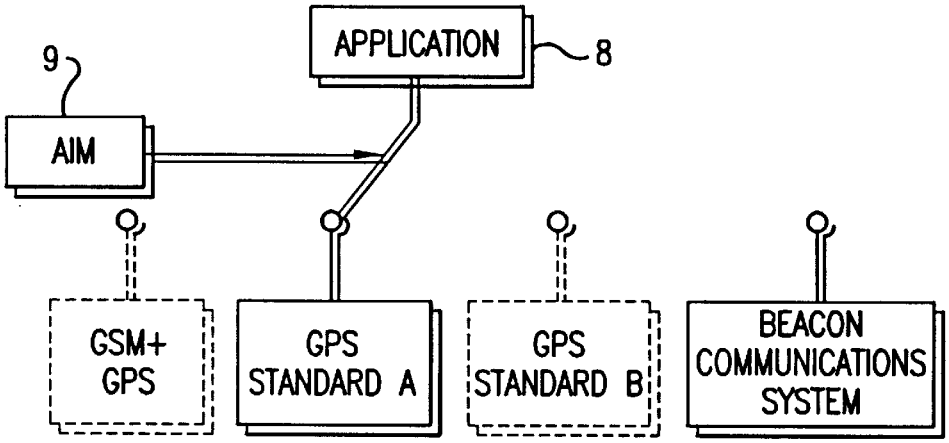
FIG. 4 is a schematic block diagram illustrating the flexibility of the devices in the system in FIGS. 1 to 3.

This device transparency is illustrated in FIG. 4 using the example of an application (8) which requires vehicle position determination. For this position determination, in the example in FIG. 4, firstly a beacon communication device and secondly a GPS receiver of the standard A type, and optionally an additional GPS receiver of the standard B type, and/or a GSM device connected with a GPS receiver are present. Upon a request for a vehicle position determination by the application(s), the adaptive application control (9) of application (8) indicates the device that is currently most favorable for determining the position of the vehicle. The adaptive application control (9) may activate several of the four devices for vehicle determination and evaluate the position data obtained redundantly independently of one another, to determine the position of the vehicle.

Figure 5:
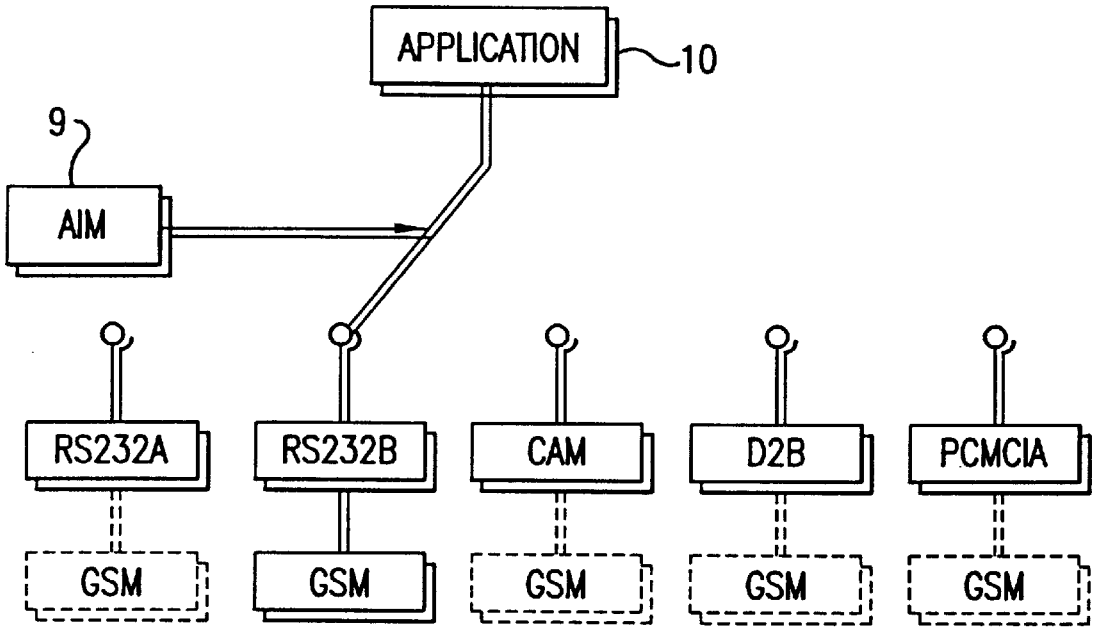
FIG. 5 is a schematic block diagram illustrating the flexibility of the interfaces of the system shown in FIGS. 1 to 3.

After the adaptive application control has determined with which device or devices communication is to take place, it also checks to determine which interfaces on this device can be accessed. This is necessary since several interfaces of the same kind may be present that must be distinguished from one another, or the device may be available in different versions with different interfaces, so that it is possible to switch the device to another similar interface or to replace it by one with a different interface without the application having to be adapted. This interface transparency is illustrated in FIG. 5 using the example of a GSM cellular phone. It is assumed for example that the GSM unit is connected to an RS232B interface; alternatively however such a GSM unit could be connected to other interfaces, such as an RS232A, a CAN, a D2B, or a PCMCIA interface. The adaptive application control (9) then chooses the currently available and/or most favorable interface for the application in question to the GSM device to be activated. The adaptive application control is also designed for performing a multiplex function with which the case can be handled in which several applications simultaneously access a communications device. This function includes prioritization of the applications and the interruptability of the various communications channels.

Integrated applications inside and outside the central computer can communicate using the same client-server mechanisms with applications and basic services within the central computer or with other external service providers, with the communications path then running through two interface gateways and two device gateways. For non-integrated applications outside the central computer, with a fixed communications relationship to the devices, the adapted application control serves to prevent a certain device also being requested by another application or the device from being located in another data network or at an address other than the one assumed by this application. The central computer in this case serves to regulate access to the devices.

Figure 6:
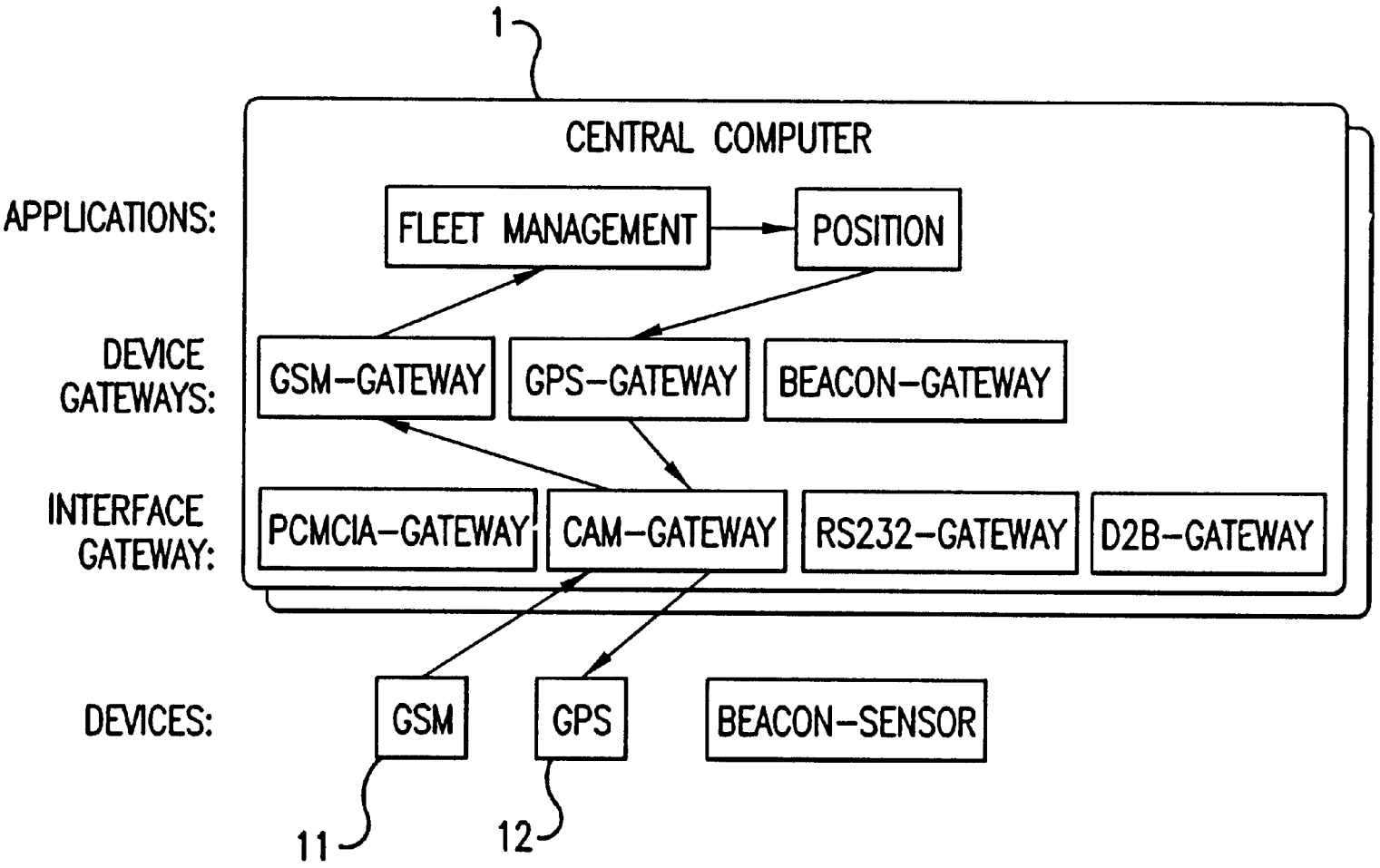
FIG. 6 is a schematic block diagram illustrating the execution of a fleet management process as a data networking application using the system shown in FIGS. 1 to 5.

FIG. 6 shows an example of the performance of a fleet management application. An external fleet management dispatcher, not shown, communicates through a GSM device (11) connected through a CAN gateway to the CAN bus of the vehicle, and through a GSM gateway with the integrated application (fleet management) in central computer (1). This application requests the function position, which in turn communicates through a CAN gateway with GPS receiver (12) which is likewise connected to the CAN bus of the vehicle.

As can be seen from the above description of a preferred embodiment, the vehicle communications system according to the invention permits flexible and comfortable performance of a wide variety of data networking tasks in a vehicle at comparatively low cost.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A vehicle communications system, comprising:

a central computer which performs data networking applications;

a plurality of individual devices for transmitting, receiving, recording, and/or processing data associated with the data networking applications;

at least one data transmission channel with associated interfaces by which the individual devices can be connected with the central vehicle computer; and an adaptive application control separate from the data networking applications which communicates with the data networking applications through a uniform data format that is independent of the interfaces and the individual devices, the application control selecting flexibly and on the basis of a required function which is required by a selected one of the data networking applications, an appropriate one of the individual devices and an appropriate one of the interfaces required for said selected one of the data networking applications, the application control controlling the necessary data transmission processes, for which purpose the application control includes device gateways and interface gateways separate from the device gateways, which gateways the application control selects independently of one another, flexibly and on the basis of said required function, in order to control the respective individual devices through the respective interfaces.

2. Vehicle communications system according to claim 1, wherein at least one of a CAN (Controller Area Network) interface, an RS232 interface, a PCMCIA (Personal Computer Memory Card International Association) interface, a D2B (Domestic Digital Bus) interface, and an IR (Infrared) interface is provided for connecting the individual devices to the central computer.

3. Vehicle communications system according to claim 1, wherein said individual devices comprise at least one of a GPS (Global Position System) receiver, a PDA (Personal Digital Assistant) unit, a GSM (Global System for Mobile) unit, a CD-ROM (Compact Disc—Read Only Memory) unit, and an RDS-TMC (Radio Data System—Traffic Message Channel) unit.

4. Vehicle communications system according to claim 1, wherein said data networking applications comprise at least one of a fleet management application, a route planning application, a remote diagnosis application, an antitheft protection application, and an electronic data communications application.

5. A vehicle communications system according to claim 1, further comprising at least two of said data transmission channels with respective ones of said associated interfaces, wherein at least one of said individual devices can be connected with the central vehicle computer via any one of at least two of said data transmission channels.

6. A method of controlling a vehicle communications system having a central computer which performs data networking applications; a plurality of individual devices for transmitting, receiving, recording, and/or processing data associated with the data networking applications; at least one data transmission channel with associated interfaces by which the individual devices can be connected with the central vehicle computer; and an adaptive application control separate from the data networking applications, the application control including device gateways and interface gateways separate from the device gateways, said method comprising:

communicating with the data networking applications via said adaptive application control through a uniform data format that is independent of the interfaces and the individual devices;

selecting flexibly and on the basis of a required function which is required by a selected one of the data networking applications, an appropriate one of the individual devices and an appropriate one of the interfaces required for said selected one of the data networking applications via said adaptive application control; and independently selecting said gateways flexibly and on the basis of said required function via said application control, in order to control the respective individual devices through the respective interfaces.

7. A method of controlling a vehicle communications system according to claim 6, further comprising connecting the individual devices to the central computer via at least one of a CAN, a RS232, a PCMCIA, a D2B, and an IR interface.

8. A method of controlling a vehicle communications system according to claim 6, wherein said individual devices comprise at least one of a GPS receiver, a PDA unit, a GSM unit, a CD-ROM unit, and an RDS-TMC unit.

9. A method of controlling a vehicle communications system according to claim 6, wherein said data networking applications comprise at least one of a fleet management application, a route planning application, a remote diagnosis application, an antitheft protection application, and an electronic data communications application.

10. A method of controlling a vehicle communications system according to claim 6, wherein said vehicle communications system has at least two of said data transmission channels with respective ones of said associated interfaces, wherein at least one of said individual devices can be connected with the central vehicle computer via any one of at least two of said data transmission channels.

11. A communications system for a motor vehicle, comprising:

a central computer installed in said motor vehicle, said central computer performing a plurality of data networking applications;

a plurality of individual devices for at least one of transmitting, receiving, recording, and processing data associated with said data networking applications;

at least two interfaces via which each of said individual devices is communicable with said central vehicle computer; and an adaptive application control separate from the data networking applications communicable with the data networking applications through a uniform data format that is independent of the interfaces and the individual devices, said application control including independent device gateways and interface gateways which gateways are selectable by said application control independently of one another, wherein responsive to a request by one of said data networking applications, said application control (a) determines an appropriate one of said individual devices with which to communicate, and (b) chooses an appropriate one of said interfaces via which to communicate.

* * * * *